US005860167A

United States Patent [19]

Lizio

[11] Patent Number: 5,860,167

[45] Date of Patent: Jan. 19, 1999

[54] HEADWEAR WITH RECEPTACLES

[76] Inventor: Ralph Lizio, 16 Salem St., Bradford, Mass. 01835-7941

[21] Appl. No.: 917,251

[22] Filed: Aug. 25, 1997

[51] Int. Cl.[6] ..... A42B 1/24

[52] U.S. Cl. ..... 2/209.13; 2/209.14; 2/422

[58] Field of Search ..... 2/209.13, 422, 2/209.14, 175.3; 362/106

[56] References Cited

U.S. PATENT DOCUMENTS

| | | | |
|---|---|---|---|
| 1,664,255 | 3/1928 | Lesser . | |
| 2,744,256 | 5/1956 | Slotkin et al. . | |
| 4,312,076 | 1/1982 | Gamm . | |
| 4,451,935 | 6/1984 | Henschel . | |
| 5,539,929 | 7/1996 | Revson . | |
| 5,567,039 | 10/1996 | Sims | 362/106 |
| 5,581,813 | 12/1996 | Henschel . | |
| 5,608,919 | 3/1997 | Case | 2/422 |

OTHER PUBLICATIONS

Magazine advertisement for cigar–holding hat (magazine unknown, date unknown but prior to application filing date).

*Primary Examiner*—Diana L. Biefeld
*Attorney, Agent, or Firm*—Morse & Altman

[57] ABSTRACT

A hat including a receptacle for securely hold an article regardless of the orientation of the hat. The receptacle is a cylindrical sleeve composed in part of a stretch fabric that forms itself snuggly about the article. In one embodiment, the receptacle is constructed nearly entirely of stretch fabric in a cylindrical shape. In another embodiment, the receptacle is composed of stretch fabric arches on a platform. The receptacle is sewn to the hat.

11 Claims, 4 Drawing Sheets

HEADWEAR WITH RECEPTACLES

BACKGROUND OF THE INVENTION

1. Field of the Invention

The present invention relates to a headwear, more specifically, to a hat that has a receptacle for securely holding an article regardless of orientation of the hat.

2. The Prior Art

Various forms of headwear for use while playing various sports have been patented. Many of these hats include pockets for storing and displaying articles. For example, U.S. Pat. No. 1,664,255 discloses a hat with a strip of cloth sewn into the side and divided into a number of small pockets. Unfortunately, if the articles do not fit snuggly in the pockets, they can fall out when the hat is removed. One solution is suggested in U.S. Pat. Nos. 2,744,256, 4,312,076, 4,451,935, and 5,539,929, which all disclose hats with sealable pockets. The shortcomings with these designs are that the stored articles are no longer visible and an extra step of having to open the pocket is needed to remove the articles. U.S. Pat. No. 5,581,813 discloses a hat with transparent pockets so that the articles are visible. However, like the hat of U.S. Pat. No. 1,664,255, the articles can fall out when the hat is removed.

Despite the number of different disclosures related to pockets for hats, there remains a need for a hat that the hold articles securely and visibly.

SUMMARY OF THE INVENTION

An object of the present invention is to provide an item of headwear having a receptacle that holds an article securely regardless of the orientation of the hat.

A further object is to provide an item of headwear in which the articles can be placed into and removed from the receptacle with a single motion.

A still further object is to provide an item of headwear in which the articles are visually identifiable when in the receptacle.

The item of headwear of the present invention includes a receptacle for securely holding an article regardless of the orientation of the headwear. The receptacle is a cylindrical sleeve composed, in whole or in part, of a stretch fabric and that is slightly smaller than the article that it is designed to accept. The combination of stretch fabric and size causes the fabric to form itself snuggly about the article to hold it securely. One-dimensional fabrics are preferred, but two-dimensional stretch fabrics is contemplated.

The receptacle has two basic embodiments, the tube embodiment and the platform embodiment. In the tube embodiment, the receptacle is constructed nearly entirely of stretch fabric, either by rolling the fabric into a tubular shape and sewing together the edges, by weaving the stretch fabric into the tubular shape, or by forming a ribbon of stretch fabric into a spiral and sewing the edges of the convolutions together. The tube embodiment has several different configurations, cylindrical for holding articles such as pencils and tubes of lip balm, slightly conical for holding articles that are not cylindrical, such as divot repair tools, flared for holding articles such as golf tees and small tubes of sun block cream, and a pair of loops for holding glasses or sunglasses.

In the platform embodiment, strips of the stretch fabric are sewn to a relatively rigid platform to form arches. The arches are axially aligned to form a tunnel over the platform into which the article is inserted. The platform has a fabric cover to help maintain a consistent appearance and a soft feel, to protect the internal portion of the platform, and to provide a fabric surface to sew the arches to. The platform prevents the article from bending and/or provides a support surface that the article can slide along from one arch to another as it is being inserted.

A snap embodiment for securing flat articles includes a button snap with the female component of the snap attached to the headwear and the male component attached to the article to be secured.

The receptacle can be located anywhere on the hat, such as completely on the head covering portion, the bill, or hanging from the edge of the hat. Preferably, the receptacle is attached by sewing. Consequently, it is preferred that the portion of the hat where the receptacle is located is composed of or covered by a fabric.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 8:
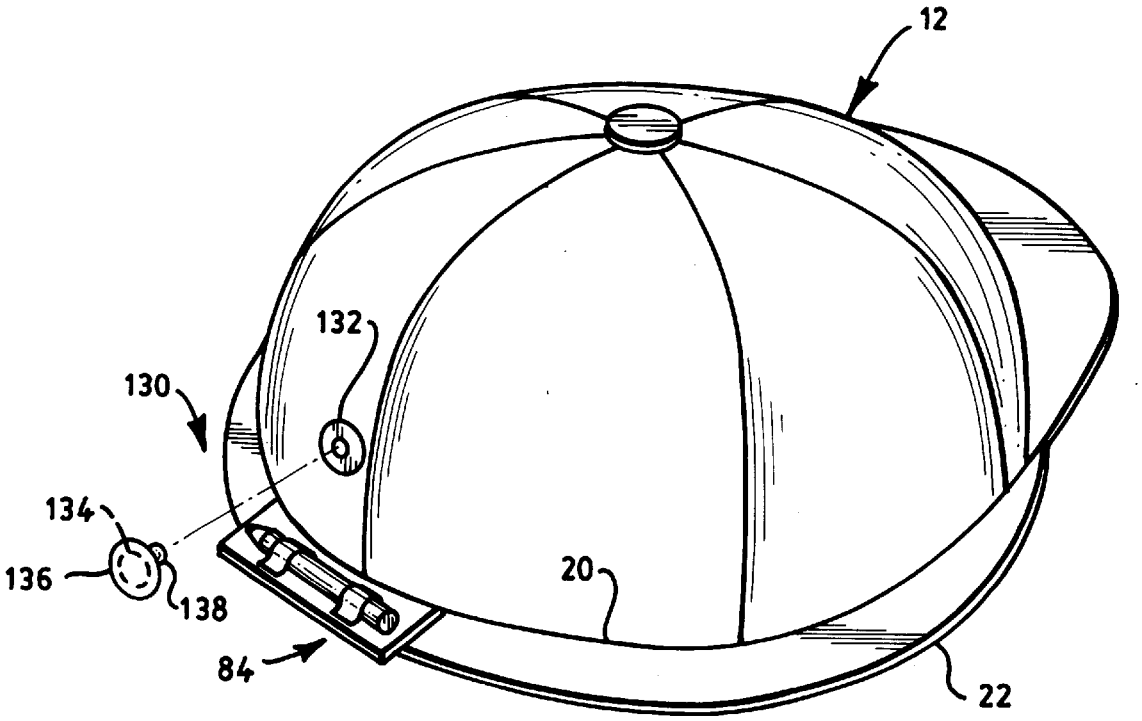
FIG. 8 is a perspective view of a sun shield and a location for the platform embodiment.
Figure 9:
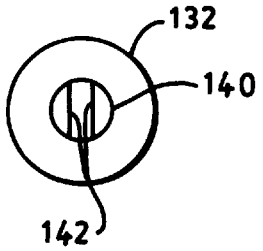
FIG. 9 is an elevational view of a female component of a button snap.

The receptacle of the present invention is capable of being attached in any orientation to a hat, and to securely hold an article in that orientation. The receptacle is adaptable to most types of headwear, including but not limited to baseball-style caps, golf hats, beach hats, and hunting hats. Typical of a hat with which the present invention is used is the baseball-style cap 12 of FIG. 1. This cap has a set of triangular-shaped fabric panels 16 forming a head-covering portion 14 and a fabric-covered bill 18 extending from the edge 20. Optionally, the cap 12 has a narrow sun shield 22 extending from the edge 20 around the circumference of the head-covering portion 14 from one side of the bill 18 to the other, as shown in FIG. 8. The sun shield 22 may be composed of two portions that overlap in the rear of the cap 12 for those caps that are adjustable.

The receptacle of the present invention is a sleeve that is approximately cylindrical in shape and that is slightly smaller than the article that it is designed to accept. The receptacle is composed, in part or in whole, of a stretch fabric that securely holds the article regardless of the position or orientation of the hat. As the article is slipped into the receptacle, it pushes the stretch fabric sides of the receptacle outwardly, causing the sides to expand. The tendency of the stretch fabric to shrink back to its original shape causes an inwardly-directed pressure on the article. The flexible nature of the stretch fabric causes it to form itself snuggly about the article, securing the article inside the receptacle until manually removed.

The diameter of the receptacle relative to the size of the article is a factor in how much pressure is put on the article. Another factor is the elasticity of the stretch fabric. The greater the relative size difference between the receptacle and the article and/or the smaller the elasticity of the stretch fabric, the greater the pressure will be on the article and the more securely the article will be held. The amount of pressure applied should be enough to hold the article securely under normal circumstances. Care must be taken to not put too much pressure on some articles, for instance, soft tubes of lip balm or sun block cream.

Figure 2:
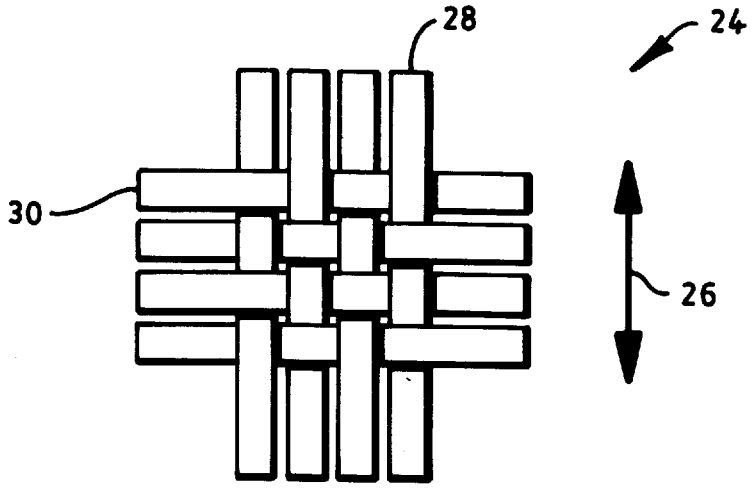
FIG. 2 is an enlarged view of a section of one-dimensional stretch fabric as used in the present invention.

One-dimensional stretch fabrics are preferred, but the use of two-dimensional stretch fabrics is contemplated. The construction of a typical one-dimensional stretch fabric 24 is shown in FIG. 2. All of the fibers 28 running in the direction of stretch, shown as 26, are composed of a rubber or similar material that stretches when pulled longitudinally and that returns to its original length when the pulling force is removed. Non-stretch fibers 30 are woven at right angles with the stretch fibers 28 in a plain weave to produce a fabric 24 that stretches in only one direction.

Tube embodiment

Figure 3:
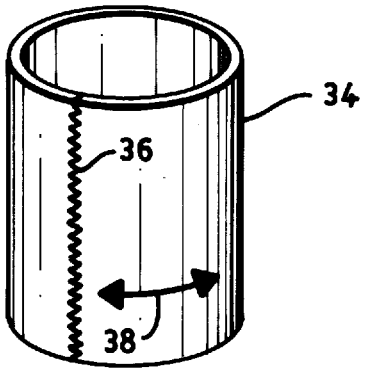
FIG. 3 is a perspective view of the rolling method for constructing a receptacle of the tube embodiment.

In the tube embodiment, the receptacle is constructed nearly entirely of stretch fabric and in one of three ways. It may be constructed, as in FIG. 3, by rolling a sheet of stretch fabric 34 into a tubular shape and sewing together the long edges 36 that are now adjacent. If one-dimensional stretch fabric is used, it is preferred that the direction of stretch be circumferential rather than longitudinal, as at 38. However, the direction of stretch may be longitudinal if the non-stretch fibers or the type of weave impart a small amount of stretch in the nominally non-stretch direction.

The receptacle may be constructed by weaving the stretch fabric into the tubular shape and then cutting it to the lengths desired. This method has the advantage of speed and consistency, since weaving of this type is performed with specially-designed machinery well-known in the art.

Figure 4:
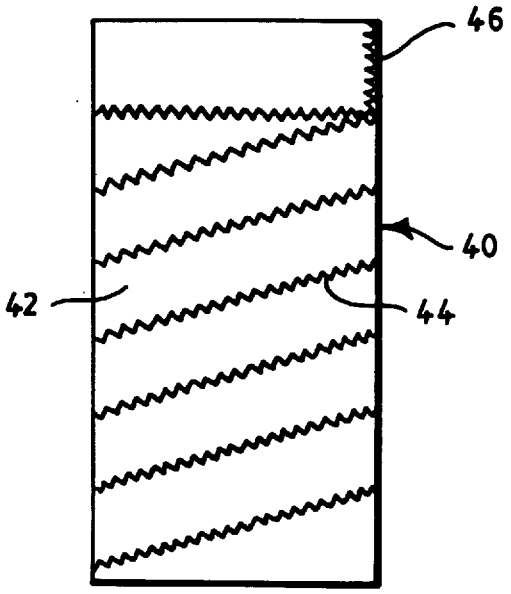
FIG. 4 is a perspective view of the spiral method for constructing a receptacle of the tube embodiment.

The receptacle may also be constructed by forming a ribbon 40 of stretch fabric into a spiral and sewing the edges 44 of the convolutions 42 together, as in FIG. 4. If greater strength and/or holding force are desired, the ribbon may be arranged so that the convolutions overlap and the edges sewn to the surface of the adjacent convolution. When one-dimensional stretch fabric is used, it is preferred that the stretch direction be approximately circumferential in the final tubular shape. To achieve this, the ribbon 40 must stretch longitudinally. The stretch is only approximately circumferential because it follows the longitudinal direction of the ribbon 40, which is a spiral. Preferably, the cut edges 46 of the fabric are bound, such as by hemming, in order to prevent unraveling.

Figure 1:
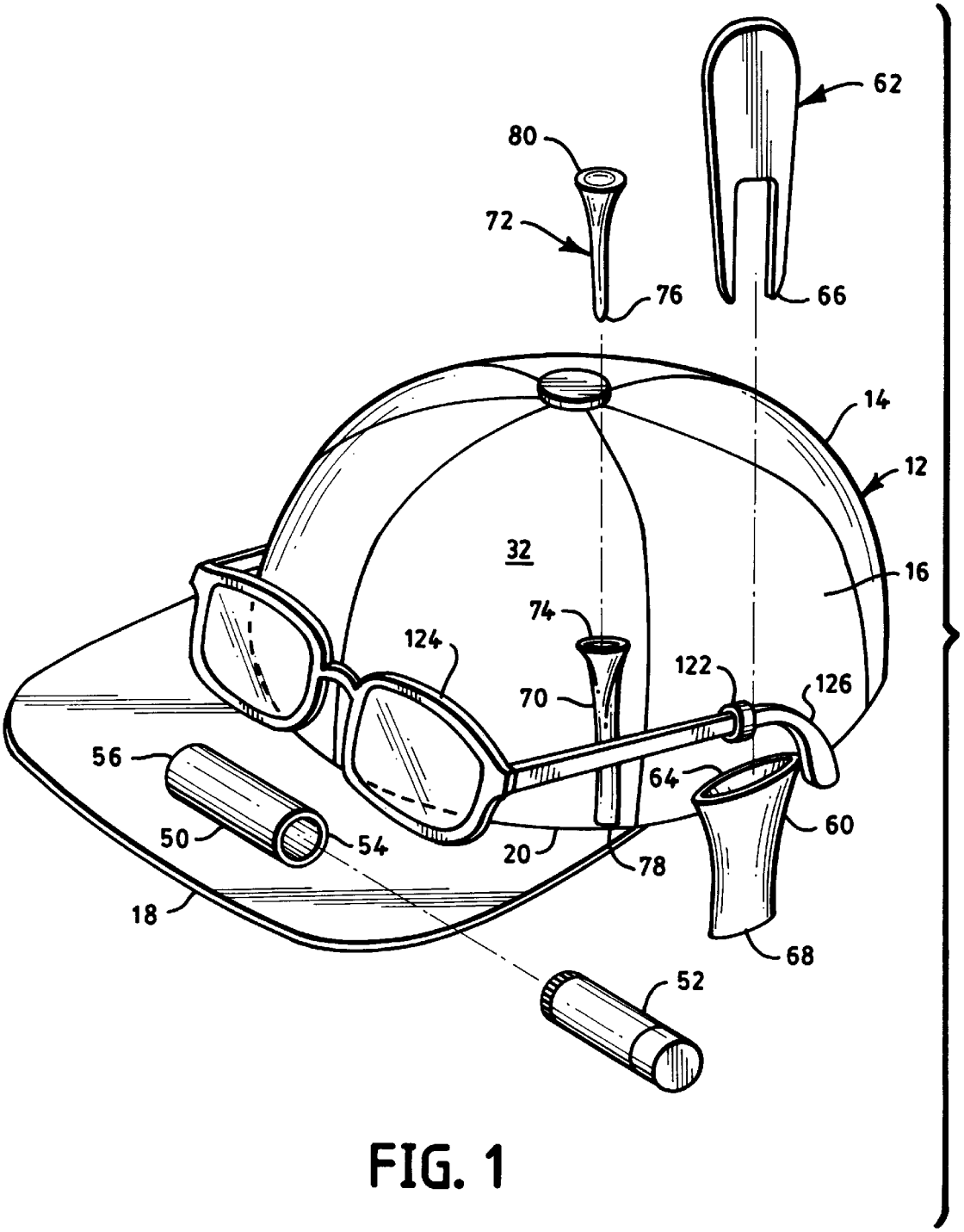
FIG. 1 is a perspective drawing of a hat incorporating embodiments of the present invention.

The tube embodiment of the receptacle of the present invention comes in several different configurations, shown in FIG. 1. One configuration is a cylindrical receptacle 50 for holding cylindrical articles, such as pencils and tubes of lip balm. Preferably, the cylindrical receptacle 50 is shorter than the article 52 so that at least a portion of the article 52 extends from the receptacle 50 for ease in removal. Optionally, the remote end 56 of the receptacle 50, the end opposite the near end 54 in which the article 52 is inserted, is closed to prevent the article 52 from being pushed completely through, maintaining the article 52 in a conveniently accessible position.

Another configuration of the present invention is a slightly conical receptacle 60 for holding articles 62 that are not cylindrical, such as divot repair tools. The conical shape more nearly conforms to the outer surface of the article 62, giving a more secure hold. Conical receptacles 60 are also preferred for articles that have pronounced edges at the end that is inserted into the receptacle. Making the near end opening 64 the same size as, or even slightly larger than, the inserting end 66 of the article 62 facilitates insertion into the receptacle 60. Optionally, the remote end 68 of receptacle 60 is closed, as described above.

A third configuration is a flared receptacle 70 for holding articles 72 that flare at one end, such as golf tees and small tubes of sun block cream or insect repellant. The receptacle near opening 74 is flared so that the narrow end 76 of the article 72 is inserted into the opening. Optionally, the remote end 78 of receptacle 70 is closed, as described above. However, it is less necessary to close the remote end in this configuration because the flared end 80 of the article 72 prevents it from extending too far into the receptacle 70.

A fourth configuration of the tube embodiment is a pair of short cylindrical loops 122 located on opposite sides of the hat 12 for holding glasses or sunglasses 124 by the temple portions 126. The receptacles 122 are small enough to securely hold the glasses 124 but have enough stretch to extend around the typically larger end of the temple portions 126.

Platform Embodiment

Figure 5:
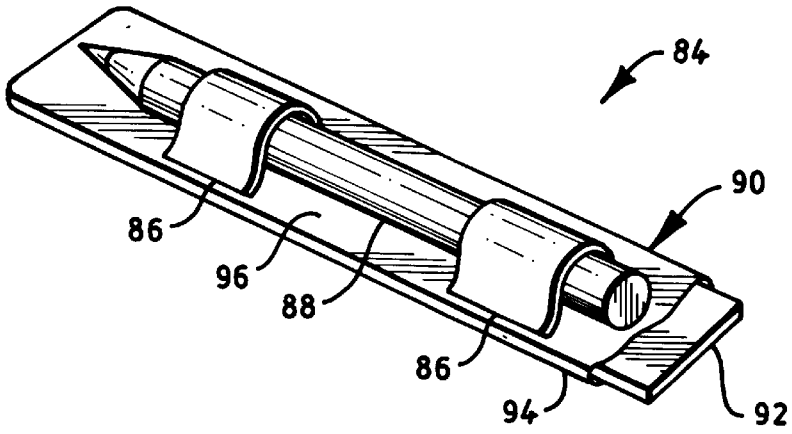
FIG. 5 is a perspective, breakaway view of the platform embodiment.

The second embodiment 84 of the present invention, the platform embodiment, is not composed entirely of stretch fabric. Rather, one or more strips of the stretch fabric are sewn to a platform 90 to form arches 86, as in FIG. 5. The platform 90 is mounted to the hat 12. This embodiment is preferably used for long straight articles 88, such as pencils. The arches 86 form a tunnel over the platform 90 into which the article 88 is inserted.

The platform 90 includes a relatively rigid internal material 92, such as a cardboard sheet, that has a fabric cover 94. The fabric cover helps to maintain a consistent appearance and a soft feel, protects the internal material 92, and provides a fabric surface 96 to sew the arches 86 to. The platform 90 keeps the arches 86 aligned, prevents the article 88 from bending, and/or provides a surface that the article 88 can slide along from one arch 86 to another as it is being inserted.

Snap Embodiment

Another embodiment of the present invention is for securing flat articles, such as golf ball markers. It consists of the female component 132 of a button snap 130 attached to the hat 12 and the male component 134 attached to or integral with the flat article 136. The button snap 130 is similar to the standard button snap use as a temporary closure on clothing. Typically, the male component 134 has a mushroom-shaped tip 138 that fits into a cylindrical hole 140 in the female component 132, where parallel stiff wires 142 latch the male component 134 into the hole 140. The article 136 is removed by pulling it from the female component 132.

Location and Attachment

Each embodiment of the receptacle is entirely self-contained, that is, it does not rely upon the surface of the hat to help secure the article. Consequently, the receptacle can be located anywhere on the hat 12 where it can be attached, as shown by several examples in FIG. 1. For example, the receptacle can be mounted completely on the hat surface 32, such as on the head-covering portion 14, like the flared receptacle 70, or on the bill 18, like the cylindrical receptacle 50. In another example, the conical receptacle 60 is mounted by one end so that the receptacle 60 hangs from the edge 20 of the hat 12. An alternate method for mounting the platform embodiment 84 is shown in FIG. 8, where one edge of the platform is attached to the edge 20 of the hat 12.

Figure 6:
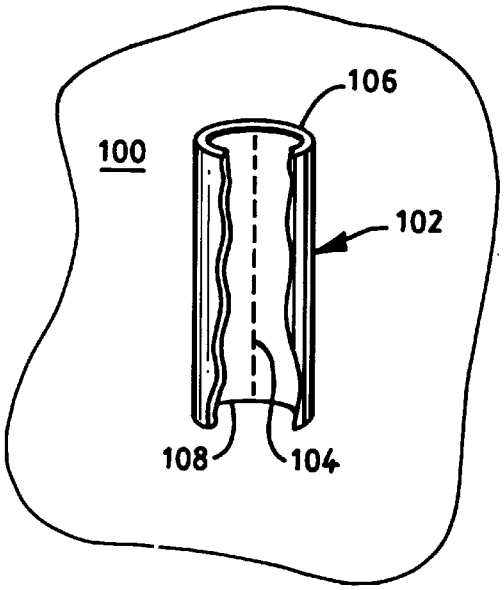
FIG. 6 is a perspective, breakaway view of one method of attaching a receptacle to a hat.

The preferred method of attaching the receptacle to the hat is by sewing. Consequently, although hats may be made out of a variety of materials, it is preferred that the portion of the hat where the receptacle is located is composed of a fabric, like the panels of the baseball cap, or covered in fabric, like the bill of a baseball cap. For those receptacles that are mounted completely on the hat, it is preferred that at least one line of stitching 104 that extends from the near end 106 to the remote end 108 of the receptacle 102 attach the receptacle 102 to the hat 100, as shown in FIG. 6. However, it is also contemplated that only the near and remote ends of the receptacle will be sewn to the hat.

Figure 7:
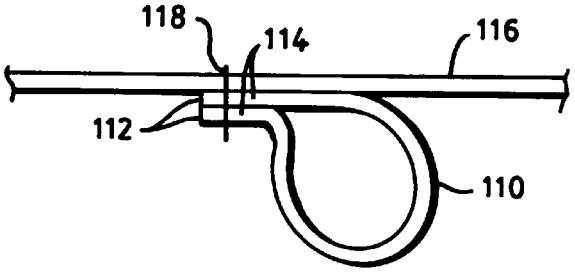
FIG. 7 is a cross-sectional view of a method of construction and attaching a receptacle to a hat.

An alternative method for attaching the receptacle to the hat also creates the tubular construction of the tube embodiment, as shown cross-section in FIG. 7. The stretch fabric 110 is rolled into a cylindrical shape. The edges 112 of the fabric 110 are extended outwardly, creating overlapping sections 114. Then the two overlapping sections 114 and the hat fabric 116 are stitched together, as at 118. This method has the advantage of only using one step to construct and attach the receptacle.

The size and location of the receptacle determines how much stitching is necessary to attach the receptacle to the hat. One line of stitching is typically sufficient for narrow receptacles, such as those used to hold a golf tee. For larger receptacles, one line of stitching may be sufficient if it is a heavy-duty stitch. However, two or more lines of stitching may be necessary. The hanging receptacle is sewn into the hem of the edge of the hat if an attachment that is more robust than merely sewing the receptacle to the surface of the fabric is needed.

Thus it has been shown and described a receptacle for use on headwear which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A hat having a receptacle for securing an article, said receptacle being a sleeve having a wall, a closed end, and an open end, a portion of said wall being composed of a stretch fabric, said receptacle being adapted to receive said article into said open end by expanding said stretch fabric and said receptacle being adapted to receive less than the entirety of said article so that at least a portion of said article remains external to said receptacle when fully inserted into said receptacle.

2. The hat of claim 1 wherein said hat has a fabric portion and said receptacle is sewn to said fabric portion.

3. The hat of claim 1 wherein said wall is composed substantially entirely of said stretch fabric.

4. The hat of claim 3 wherein said receptacle is cylindrical.

5. The hat of claim 3 wherein said receptacle is conical.

6. The hat of claim 3 wherein said open end is flared.

7. The hat of claim 1 wherein said stretch fabric stretches circumferentially about said sleeve.

8. A hat having a fabric portion and a receptacle for securing an article sewn to said fabric portion, said receptacle being a sleeve composed substantially entirely of a stretch fabric and having a closed end and an open end, said stretch fabric stretching circumferentially about said sleeve, said receptacle being adapted to receive said article into said open end by expanding said stretch fabric and said receptacle being adapted to receive less than the entirety of said article so that at least a portion of said article remains external to said receptacle when fully inserted into said receptacle.

9. The hat of claim 8 wherein said receptacle is cylindrical.

10. The hat of claim 8 wherein said receptacle is conical.

11. The hat of claim 8 wherein said open end is flared.

* * * * *